US007913876B2

(12) United States Patent
Muenzenberger et al.

(10) Patent No.: US 7,913,876 B2
(45) Date of Patent: Mar. 29, 2011

(54) CARTRIDGE FOR MULTICOMPONENT MASSES

(75) Inventors: Herbert Muenzenberger, Wiesbaden (DE); Ralf Willner, Tussenhausen (DE)

(73) Assignee: Hilti Aktiengesellschaft, Schaan (LI)

( * ) Notice: Subject to any disclaimer, the term of this patent is extended or adjusted under 35 U.S.C. 154(b) by 913 days.

(21) Appl. No.: 11/430,688

(22) Filed: May 9, 2006

(65) Prior Publication Data

US 2006/0255062 A1 Nov. 16, 2006

(30) Foreign Application Priority Data

May 10, 2005 (DE) ..... 10 2005 000 056

(51) Int. Cl.

| | |
|---|---|
| ***B65D 35/22*** | (2006.01) |
| ***B65D 35/56*** | (2006.01) |
| ***B65D 25/08*** | (2006.01) |
| ***B65D 21/02*** | (2006.01) |
| ***B67D 7/70*** | (2010.01) |

(52) U.S. Cl. ..... 222/94; 222/136; 222/105; 222/386.5; 222/95; 206/219; 206/568; 220/23.89; 220/62.21

(58) Field of Classification Search ..... 222/94, 222/95, 96, 107, 105, 134, 136, 326, 327, 222/145.6, 325, 137; 206/219, 568; 220/23.89, 220/62.21, 62.22; 383/38

See application file for complete search history.

(56) References Cited

U.S. PATENT DOCUMENTS

| | | | | |
|---|---|---|---|---|
| 2,871,218 | A * | 1/1959 | Schollenberger | 525/440.12 |
| 3,206,074 | A * | 9/1965 | Hoffmann | 222/94 |
| 3,467,269 | A * | 9/1969 | Newton | 215/6 |
| 3,896,602 | A * | 7/1975 | Petterson | 53/411 |
| 3,915,297 | A | 10/1975 | Rausch | |
| 4,007,831 | A * | 2/1977 | Bernhardt | 206/219 |
| 4,308,973 | A * | 1/1982 | Irland | 220/495.01 |
| 5,242,085 | A * | 9/1993 | Richter et al. | 222/105 |
| 5,405,056 | A | 4/1995 | Mills | |
| 5,407,629 | A * | 4/1995 | Schmidt et al. | 264/512 |
| 5,615,803 | A * | 4/1997 | Hatakeyama et al. | 222/94 |
| 5,647,510 | A | 7/1997 | Keller | |
| 6,184,264 | B1 * | 2/2001 | Webster | 522/182 |
| 6,691,494 | B2 * | 2/2004 | Nomoto et al. | 53/410 |
| 6,742,676 | B2 * | 6/2004 | Nakamura et al. | 222/95 |
| 6,945,428 | B2 * | 9/2005 | Shimizu et al. | 222/105 |
| 6,945,429 | B2 * | 9/2005 | Gosis et al. | 222/105 |
| 7,337,925 | B2 * | 3/2008 | Imaizumi et al. | 222/145.3 |
| 2002/0023934 | A1 * | 2/2002 | Scheifele | 222/94 |

* cited by examiner

*Primary Examiner* — Kenneth Bomberg
*Assistant Examiner* — Stephanie E Williams
(74) *Attorney, Agent, or Firm* — Abelman, Frayne & Schwab

(57) ABSTRACT

Cartridge for a multicomponent mass, has a housing (12) formed as a hollow profile and in which a multi-chamber pouch (13) having a plurality of chambers (14, 15) separated from each other in a longitudinal direction, is arranged and a large-surface connection region for releasably connecting the multi-chamber pouch (13) and the housing (12) and extending along a longitudinal extend of the multi-chamber pouch (13) and at least along a portion of the circumference of the multi-chamber pouch (13).

8 Claims, 2 Drawing Sheets

11
12
13
14
15
16
17
18
19
20
21
26
27
28
II
II

CARTRIDGE FOR MULTICOMPONENT MASSES

BACKGROUND OF THE INVENTION

1. Field of the Invention

The present invention relates to a cartridge for a multicomponent mass and having a housing formed as a hollow profile and a multi-chamber pouch arranged in the housing and having a plurality of chambers separated from each other in a longitudinal direction.

2. Description of the Prior Art

Multicomponent masses include a main component and at least one additional component, which react with each other and which are mixed with each other shortly before the application of a multicomponent mass. In the constructional industry, e.g., multicomponent mortar masses, which are often packed in multi-chamber pouches in form of hose or foil bags, are supplied to the user as cartridges. E.g., German Publication DE 39 04 639 A1 discloses multi-chamber hose packs formed of a foil material and having a main chamber and an auxiliary chamber separated from each other in a longitudinal direction.

Using suitable squeezing-out devices, the multicomponent mass is mixed with a mixing member to a ready-to-use mass and is squeezed out. Maintaining of the mixing ratios during discharging of the multi-chamber pouch is essential for the suitability of the mass for its intended use.

U.S. Pat. No. 5,647,510 discloses a cartridge for a multicomponent motar mass having a housing, which is formed as a hollow cylinder, and a multi-chamber pouch which is arranged in the housing and the chambers of which are separated from each other in a longitudinal direction. At the discharge end of the housing, a multi-part head is provided. The hose pouch is fixed on the free end of the head. The larger chamber, e.g., the main chamber, has a direct outlet in the discharge opening of the cartridge. The second chamber, e.g., the auxiliary chamber is arranged on a separate section of the head and has a channel section that forms part of the discharge opening and that throttles the mass from the auxiliary chamber. The drawback of the known cartridge consists in that the manufacturing of the head is very complicated and expensive.

With cartridges, which are kept for a long time in a partially discharged condition or at a high temperature, liquid components of one of the mortar components, e.g., rubber, leak out and can migrate between the multi-chamber pouch and the inner profile or the inner wall of the cartridge housing. This infiltration can cause a reduction of the friction forces between the foil material and the inner wall of the housing, so that during the discharge process, the auxiliary chamber folds or is reduced in size. This results in a significant change of the mixing ratios, and a proper hardening of the mixed mass and thereby, obtaining of the desired load values cannot be insured.

Accordingly, an object of the present invention is to provide a cartridge having a housing and a multi-component pouch arranged in the housing and with which, folding or reduction in size of the chambers during discharge process is prevented even after storage of the partially emptied cartridge or after storage in a non-opened condition at a high temperature.

Another object of the invention is to provide a cartridge described immediately above and which can be used with conventional squeezing-out devices.

SUMMARY OF THE INVENTION

These and other objects of the present invention, which will become apparent hereinafter, are achieved by providing a large-surface connection region for releasably connecting the multi-chamber pouch and the housing and extending along a longitudinal extent of the multi-chamber pouch and at least along a portion of the circumference of the multi-chamber pouch.

With the releasable connection of the multi-chamber pouch and the housing, regional migration of a fluid component of one of the components, e.g., of a mortar mass, is prevented, and reduction in size or folding of the chambers of the multi-chamber pouch during a discharge process is likewise prevented. The connection is so formed that during the discharge process the outer profile of the multi-chamber pouch is separated from the inner profile of the housing, without generating high counter-forces. If the connection between the multi-chamber pouch and the housing is too strong, the squeezing-out piston can regionally tear off the pouch during the discharge of the foil pack, which negatively influences the mixing ratio.

The inventive cartridge permits to substantially increase the service life of the cartridge in a partially discharged condition, which is very advantageous both for practical and economical reasons. In addition, the inventive cartridge insures a stable mixing ratio of masses stored in the multi-chamber pouch even when a predetermined storage temperature, e.g., when the cartridge is carried in a vehicle in the height of the summer, is not maintained.

Advantageously, the large surface connection region extends only along the portion of the circumference of an outer profile of one of the chambers. Thereby reduction in size or folding of this chamber of the multi-chamber pouch during the discharge process is advantageously prevented.

Advantageously, the large-surface connection region extends along an outer profile of the multi-chamber pouch in the region of the smaller chamber. In the smaller chamber or in the auxiliary chamber, a hardening agent is stored, the metering of which significantly influences the setting or hardening characteristic of the ready-to-use mass. In this case or with such cartridge, a stable mixing ratio at a partially discharged condition of the pouch or after an extended storage of the cartridge is insured.

Advantageously, the large-surface connection region is formed by an adhesive provided between an inner profile of the housing and an outer profile of the multi-chamber pouch. The adhesive is so selected that the outer profile of the multi-chamber pouch, which is glued to the inner profile or the inner wall of the housing, at least region wise, is separated therefrom during the discharge process, without generating noticeably high counter-forces. Ideally, the adhesive is so formed that it is applied in a liquid and low-viscous condition and then is transformed into a plastoelastic mass with a sufficient adhesiveness but with a small peel force.

In this case, under the peel force is understood a sufficient strength against axial forces acting along the longitudinal axis of the cartridge, which strength is overcome upon application of a sufficient pressure, e.g., applied by a squeezing-out piston to the multi-chamber pouch, without generating high counter-forces. The viscosity of the adhesive during the application of the same is advantageously so selected that processing in an automatic installation is possible. The adhesive is applied, e.g., to the outer profile of the multi-chamber pouch before it is mounted in the housing. Upon insertion of the multi-chamber pouch into the housing, the adhesive is distributed along the longitudinal direction. Alternatively, the adhesive can be applied to the inner profile of the housing before insertion of the multi-chamber pouch. With the alternative application of the adhesive, likewise, the adhesive is distributed along the longitudinal direction upon insertion of the multi-chamber pouch into the housing.

Preferably, the thickness of the layer of the adhesive varies between 0.01 mm and 2 mm and, advantageously, between 0.5 mm and 1 mm. With the layer thickness in this range, an adequate adhesion of the adhesive during storage and, at the same time, separation of the connected regions of the outer profile of the multi-chamber pouch form the inner profile of the housing during a discharge process are insured.

According to an advantageous embodiment of the cartridge, the adhesive is formed as a physically hardening glue such as, e.g., solvent-containing glue, dispersion glue, rubber glue, hot setting glue, contact glue, pressure-sensitive glue and plastisol.

According to a further advantageous embodiment of the cartridge, the adhesive is formed as a chemically hardening glue that is available as a single- or multicomponent system. E.g., systems, which are based on cyanoacrylate, polyurethane, silicon, metacrylat, epoxy-amine systems and silano-modified polymers are used. Silicon-rubber or silano-modified polyether are also suitable systems.

Particularly advantageous, as adhesive, is the polyurethane glue which, in a preferable form, has a NCO/OH-equivalent ratio from 0.8 to 1.2. With such polyurethane glue, an adequate adhesiveness and a small peel strength are obtained.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
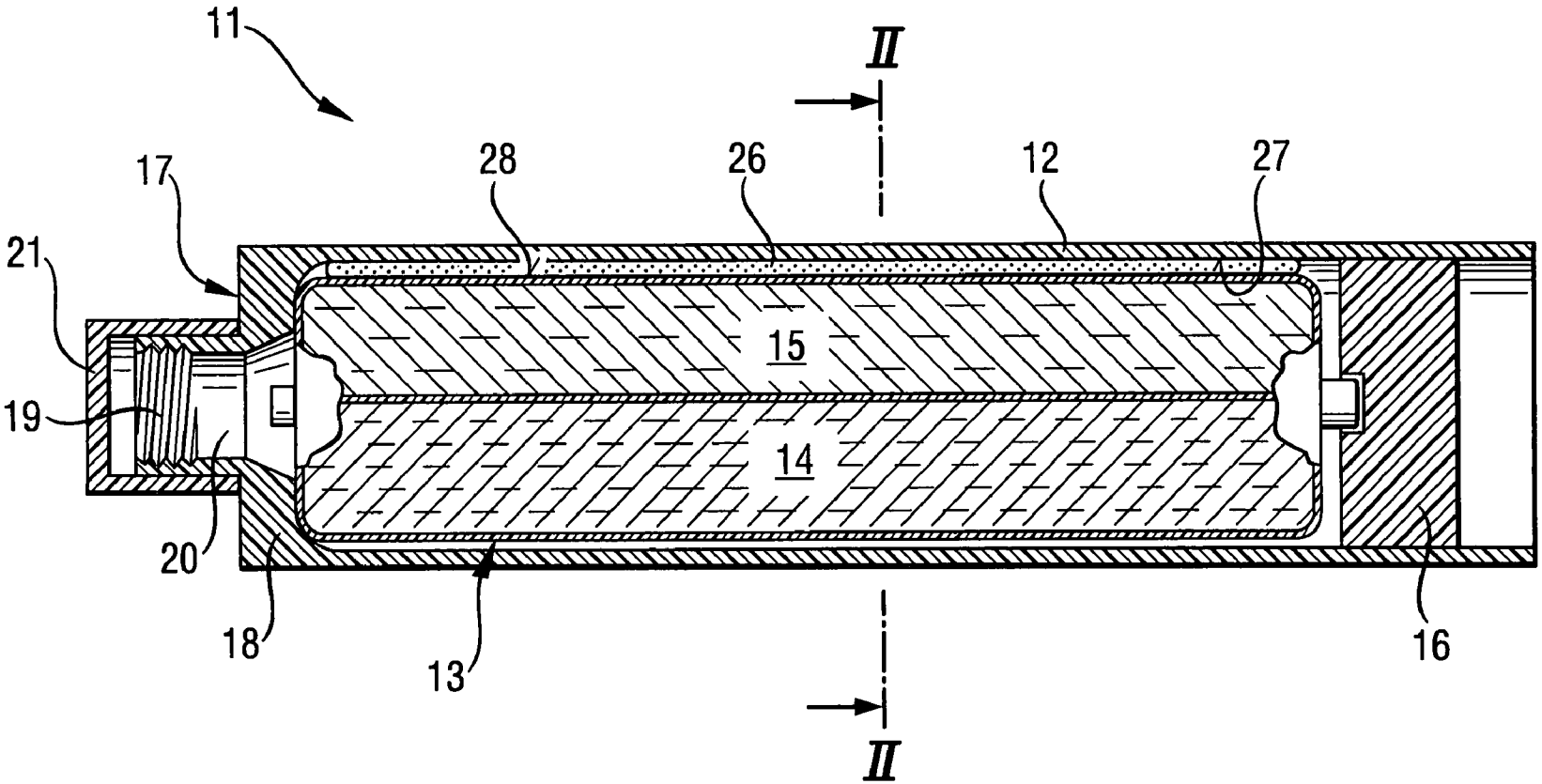
FIG. 1 a longitudinal cross-sectional view of a cartridge according to the present invention.
Figure 2:
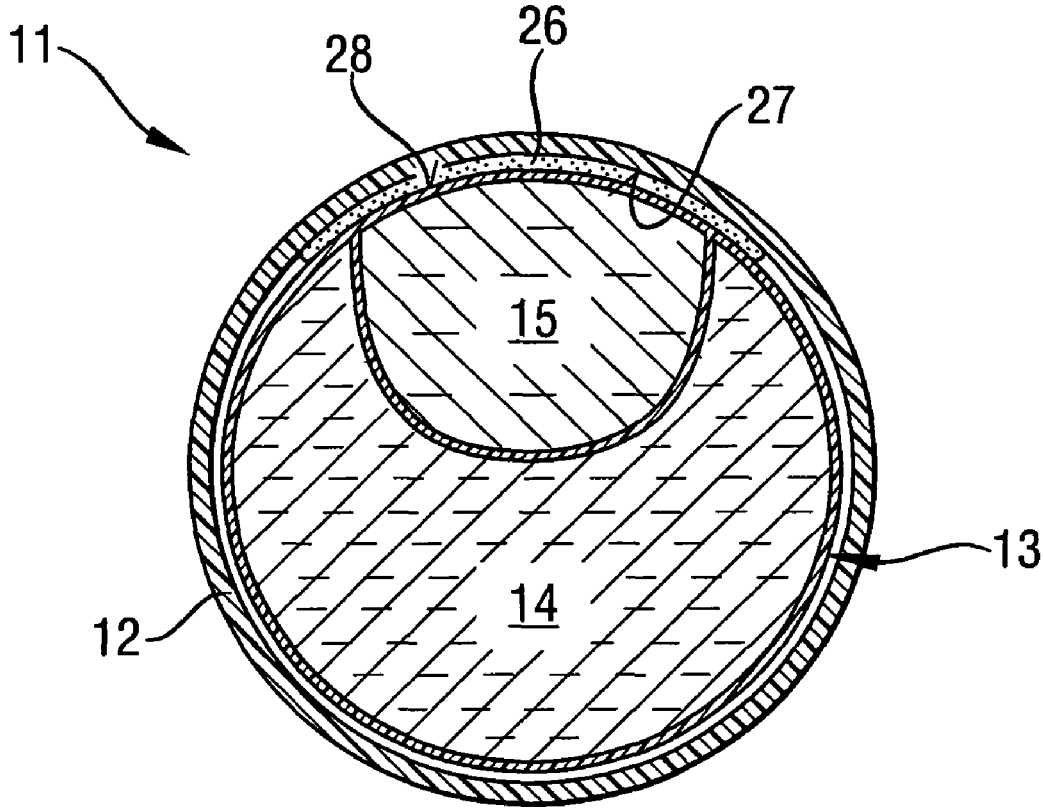
FIG. 2 a cross-sectional view along line II-II in FIG. 1 at an increased, in comparison with FIG. 1, scale.

A cartridge 11 for a multicomponent mass according to the present invention, which is shown in the drawings, has a housing 12 in which a multi-chamber pouch 13 for a squeezable-out multicomponent mass, in particular, a multicomponent motar mass is arranged. The multi-chamber pouch 13 is formed of a foil material. The multi-chamber pouch 13 has a first chamber 14, which forms the main chamber, and a second chamber 15 which contains a hardening agent and forms an auxiliary chamber. The first chamber 14 and the second chamber 15 of the multi-chamber pouch 13 are separated in the longitudinal direction. In the chambers 14 and 15, the to-be-mixed components of the multicomponent mass are packaged separately from one another. In the housing 12, there is further provided a squeezing-out piston 16 that applies pressure to the multi-chamber pouch 13 for squeezing the components out. At its discharge end 17, the housing 12 has a head 18 with an outlet opening 20 and a threaded connection 19 for a mixing element (not shown). In the storage condition of the cartridge 11, the outlet opening 20 is closed, e.g., with a cover cap 21.

For a releasable connection of the multi-chamber pouch 13 and the housing 12, there is provided a large-surface connection region that extends along the longitudinal extent of the multi-chamber pouch 13 and along a portion of the circumference of the multi-chamber pouch 13. The large-surface connection region extends, in the embodiment shown in the drawings, along the circumference of the outer profile 28 of the second chamber 15. The large-surface connection region is formed by adhesive 26 provided between the inner profile 27 of the housing 12 and the outer profile 28 of the multi-chamber pouch 13, and has a thickness of 0.7 mm. In the disclosed embodiment, the adhesive 26 is a chemically hardening glue in form of a polyurethane glue with NCO/OH equivalent ratio of 1.

A desired flexibility of the polyurethane glue is achieved, e.g., with admixture of at least 20%, by volume, of a polymer of butadiene containing hydroxyl groups (e.g., Poly BD R-45 HTLO of the firm Sartomer or Liquiflex H of the firm Petroflex). The selected NCO/OH-equivalent ratio insures the necessary adhesion of the polyurethane glue.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A cartridge for a multi-component mass, comprising a housing (12) formed as a hollow profile; a multi-chamber pouch (13) arranged in the housing (12) and having a plurality of chambers (14, 15) separated from each other in a longitudinal direction; and a connection region formed by an adhesive provided between an inner profile of the housing and an outer profile of the multi-chamber pouch releasably connecting the multi-chamber pouch (13) and the housing (12) and extending along a longitudinal extent of the multi-chamber pouch (13) between only a portion of a circumference of the outer profile (28) of the multi-chamber pouch (13) and a respective portion of a circumference of the inner profile of the housing (12), a piston located in the housing for applying pressure to the pouch, the adhesive connection region is so formed that upon application of pressure on the pouch by the piston during a discharge process the outer profile of the multi-chamber pouch is separated from the inner profile of the housing, without generating high counter-forces at the adhesive connection region, such that the adhesive connection region between the multi-chamber pouch and the housing is not so strong as to regionally tear the pouch during the discharge process.

2. A cartridge according to claim 1, wherein the adhesive (26) has a layer thickness between 0.01 mm and 2 mm.

3. A cartridge according to claim 2, wherein the adhesive (26) has the layer thickness between 0.5 mm and 1 mm.

4. A cartridge according to claim 1, wherein the adhesive is a physically hardening glue.

5. A cartridge according to claim 1, wherein the adhesive (26) is a chemically hardening glue.

6. A cartridge according to claim 5, wherein the adhesive (26) is a polyurethane glue.

7. A cartridge according to claim 6, wherein the polyurethane glue has NCO/OH-equivalent ratio from 0.8 to 1.2.

8. A cartridge according to claim 1, wherein the chambers (14, 15) have different circumferential dimensions, and the connection region extends substantially in a circumferential region of a smaller one of the chambers (14, 15).

* * * * *